United States Patent [19]

Unger

[11] 4,068,203

[45] Jan. 10, 1978

[54] BIMETALLIC CIRCUIT BREAKER

[75] Inventor: Robert P. Unger, East Windsor, N.J.

[73] Assignee: Heinemann Electric Company, Trenton, N.J.

[21] Appl. No.: 696,302

[22] Filed: June 15, 1976

[51] Int. Cl.[2] ..... H01H 71/58

[52] U.S. Cl. ..... 337/56; 337/91; 337/107; 337/113

[58] Field of Search ..... 337/37, 52, 53, 56, 337/66, 72, 79, 91, 107, 113

[56] References Cited

U.S. PATENT DOCUMENTS

| | | | |
|---|---|---|---|
| 2,828,385 | 3/1958 | Malone | 337/113 |
| 3,107,282 | 10/1963 | Desio et al. | 337/91 |
| 3,321,597 | 5/1967 | Meijer | 337/56 |
| 3,778,739 | 12/1973 | Burch | 337/72 |

FOREIGN PATENT DOCUMENTS

| | | | |
|---|---|---|---|
| 1,161,343 | 1/1964 | Germany | 337/91 |

*Primary Examiner*—William H. Beha, Jr.
*Attorney, Agent, or Firm*—Joseph G. Denny, III; Peter J. Patane

[57] ABSTRACT

A bimetallic circuit breaker with an electrical insulating slide interposed between the contacts thereof in the contacts open position in which the terminals, the bimetallic element, the insulator slide, the button (connected to the slide) and the spring biasing the button and the slide to the contacts open position of the circuit breaker are all carried by an insulator frame so that they may all be preassembled together and inserted into the housing for the circuit as one sub-assembly.

19 Claims, 19 Drawing Figures

FIG. 4
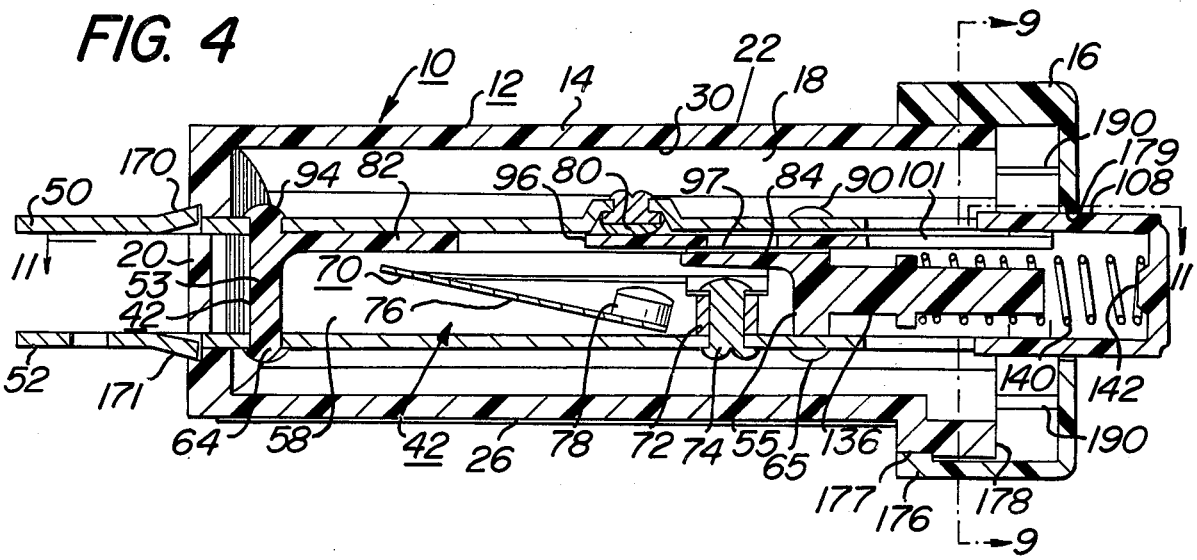
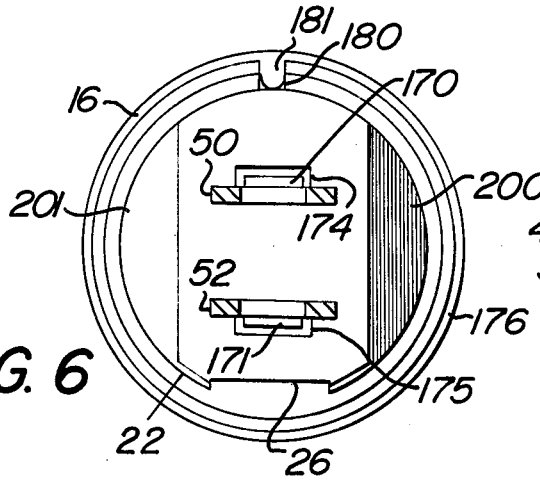
FIG. 6
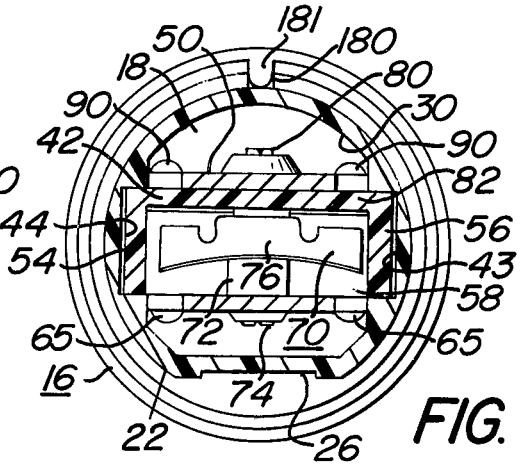
FIG. 7
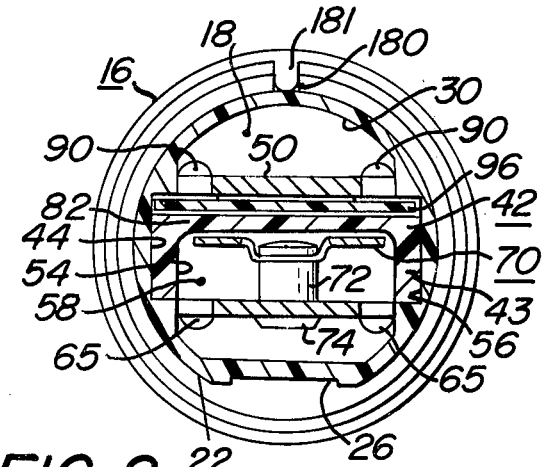
FIG. 8
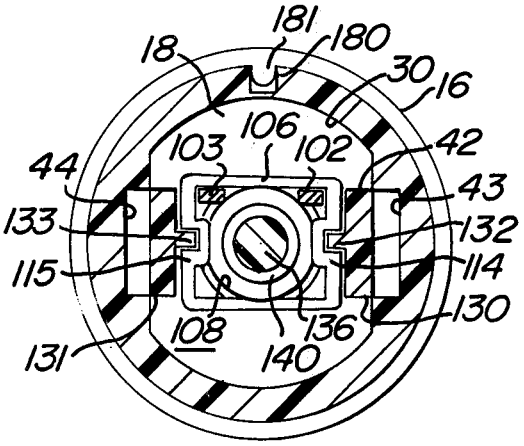
FIG. 9

FIG. 5
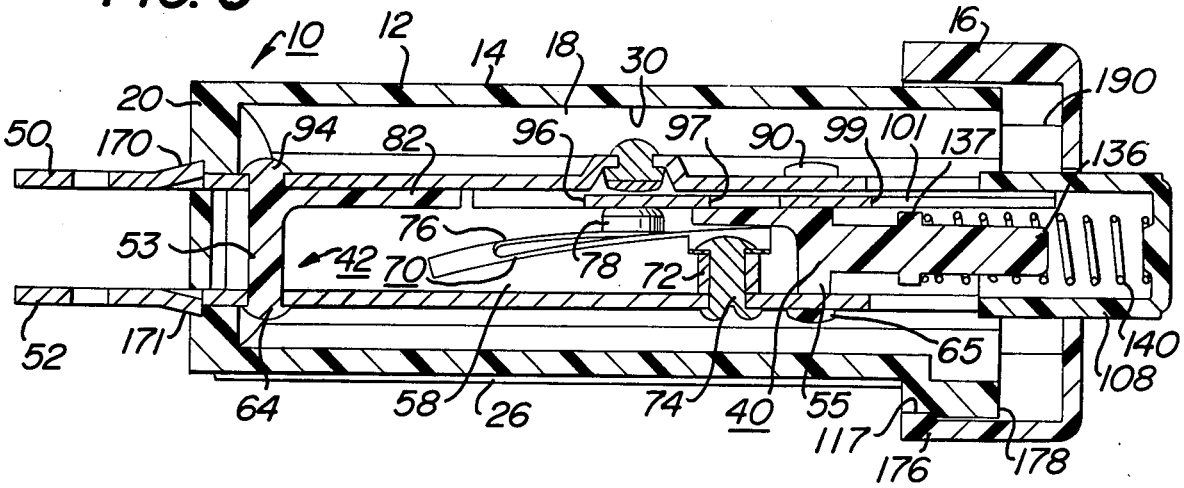
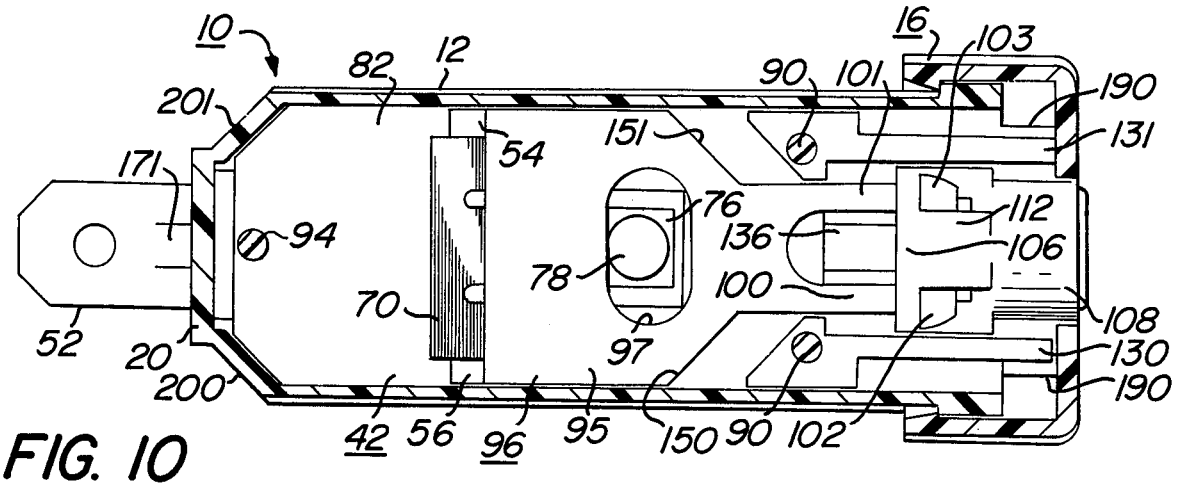
FIG. 10
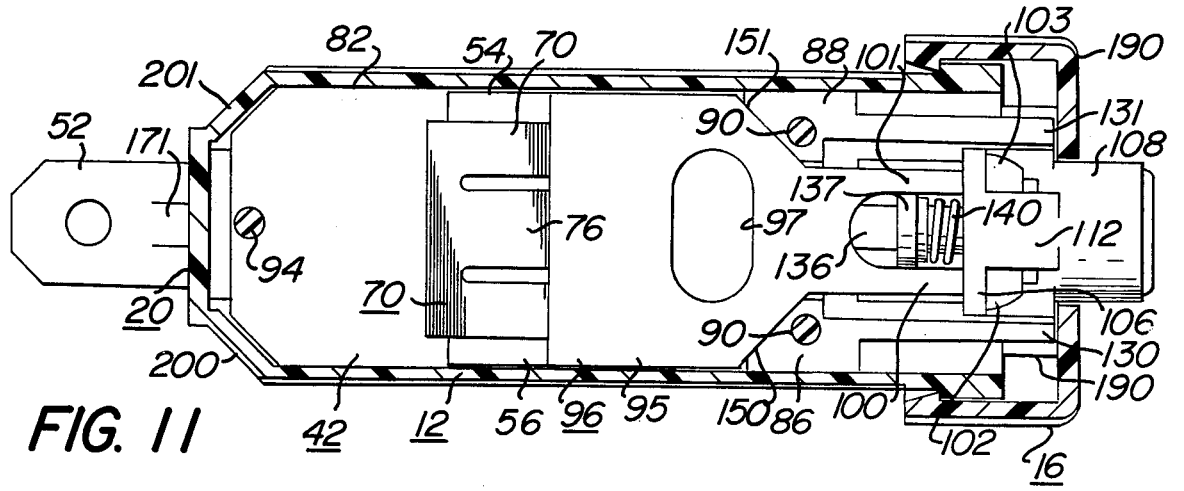
FIG. 11

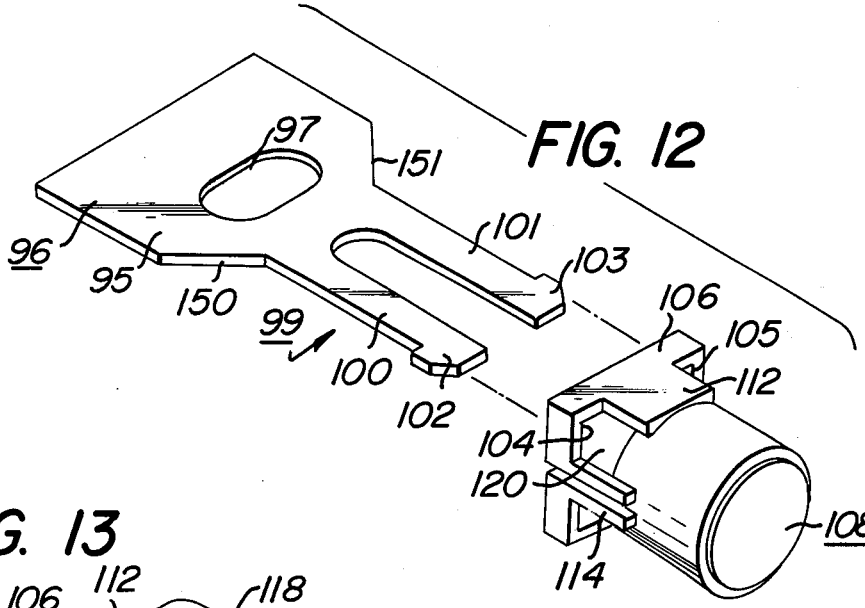
FIG. 12
FIG. 13
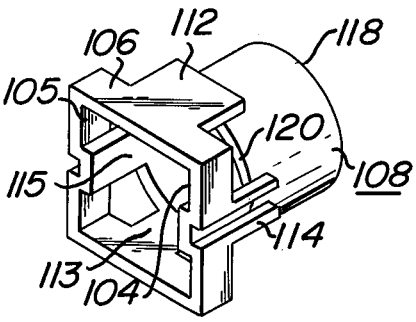
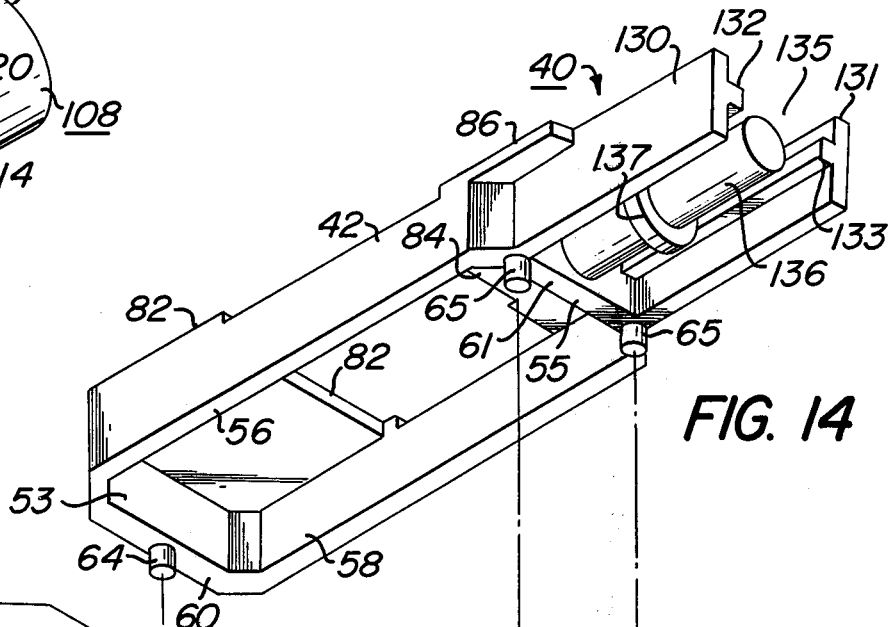
FIG. 14
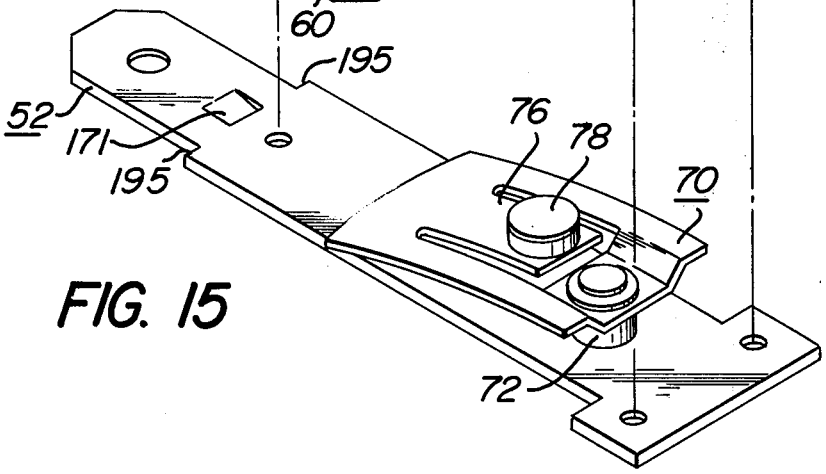
FIG. 15

FIG. 16
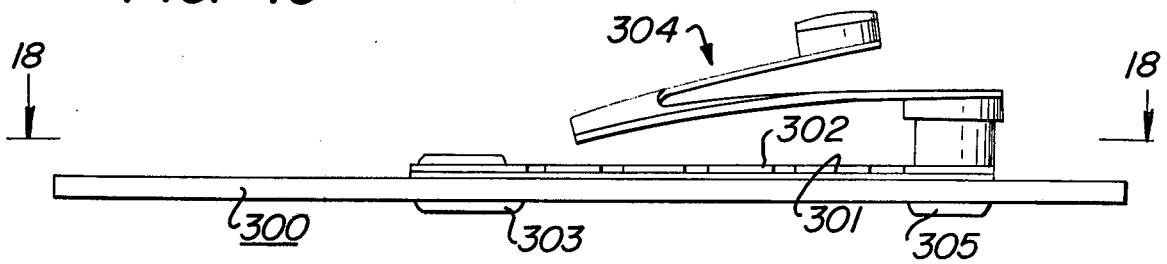
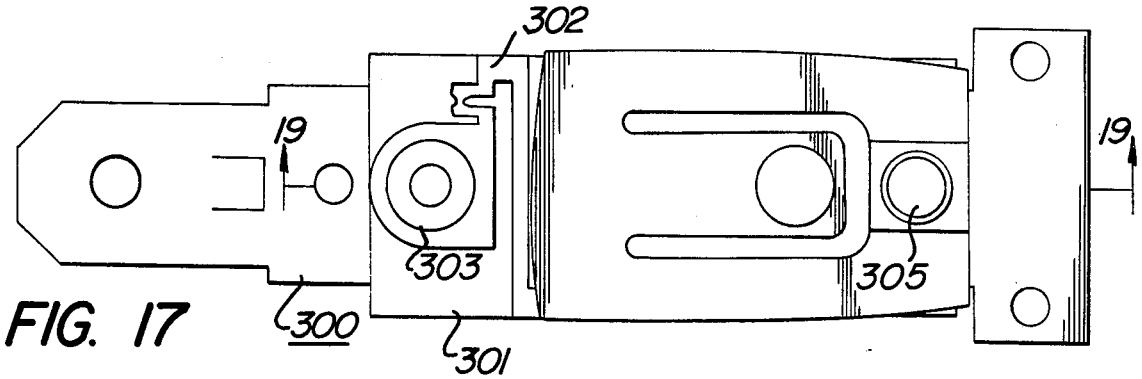
FIG. 17
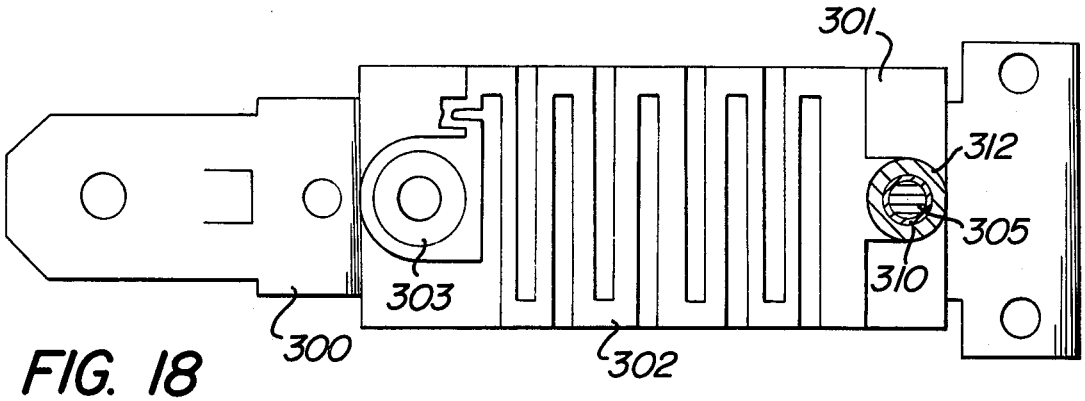
FIG. 18
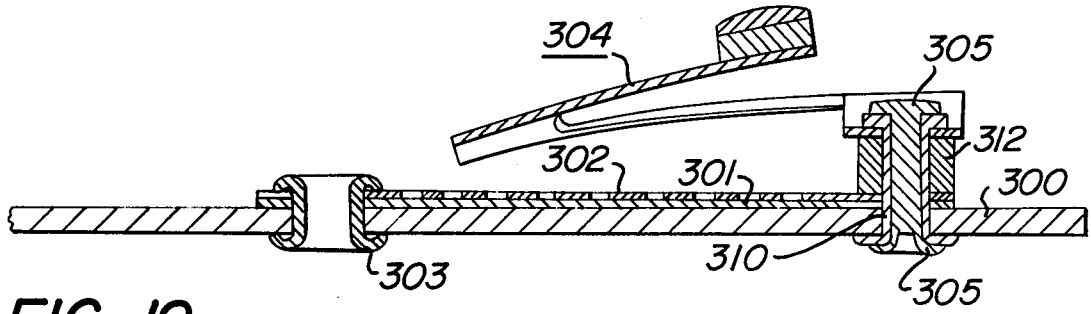
FIG. 19

BIMETALLIC CIRCUIT BREAKER

BACKGROUND OF THE INVENTION

This invention relates generally to electric circuit breakers of the bimetallic type.

It appears that there is a need for a bimetallic circuit breaker which has an elongated form and whose outer housing would be generally circular in cross-section taken transverse to the longitudinal axis thereof. Such a bimetallic circuit breaker would have an outer configuration approximately corresponding to a known elongated fuse to provide a circuit interrupter which would open the circuit on predetermined conditions and which could be reset to the contacts closed position thereafter. Thus, such a bimetallic circuit breaker could be substituted in apparatus which would otherwise include a fuse.

However, since fuses are usually sold for less than comparable circuit breakers, any circuit breaker intended to be substituted for a fuse must be constructed economically so as to be competitive with fuses.

BRIEF SUMMARY OF THE INVENTION

Thus, it is an object of this invention to provide a relatively low cost and economical bimetallic circuit breaker which will be economically competitive with a comparable fuse.

Also, it is another object of this invention to provide a bimetallic circuit breaker which includes internal parts of the circuit breaker which may be assembled together as one sub-assembly, tested and then placed within the housing so as to provide an economical construction and method of assembly.

This invention provides a bimetallic circuit breaker comprising a housing which is elongated and circular in cross-sectin. The housing comprises a tubular case having a substantially closed end and an opposite, open end.

Within the case is inserted, from the open end, a subassembly comprising all of the internal parts of the circuit breaker, and thereafter a cover is placed over the open end of the case through which the button (connected to the slide) extends when the contacts of the circuit breaker move to the open position.

The sub-assembly comprises an insulator frame which carries the terminals, the insulator slide and button, and the spring which biases the insulator slide and button to the contacts open position.

The foregoing and other objects of the invention, the principles of the invention and the best mode in which I have contemplated applying such principles will more fully appear from the following description and accompanying drawings in illustration thereof.

BRIEF DESCRIPTION OF THE VIEWS

In the drawings:

FIG. 4 is a longitudinal sectional view, similar to FIG. 3, but showing the momentary tripped open position of the bimetallic blade;

FIG. 5 is a longitudinal sectional view, similar to FIG. 4, but showing the contacts open position of the circuit breaker;

FIG. 6 is a left hand end view of the circuit breaker, as viewed in FIG. 3;

Figure 3:
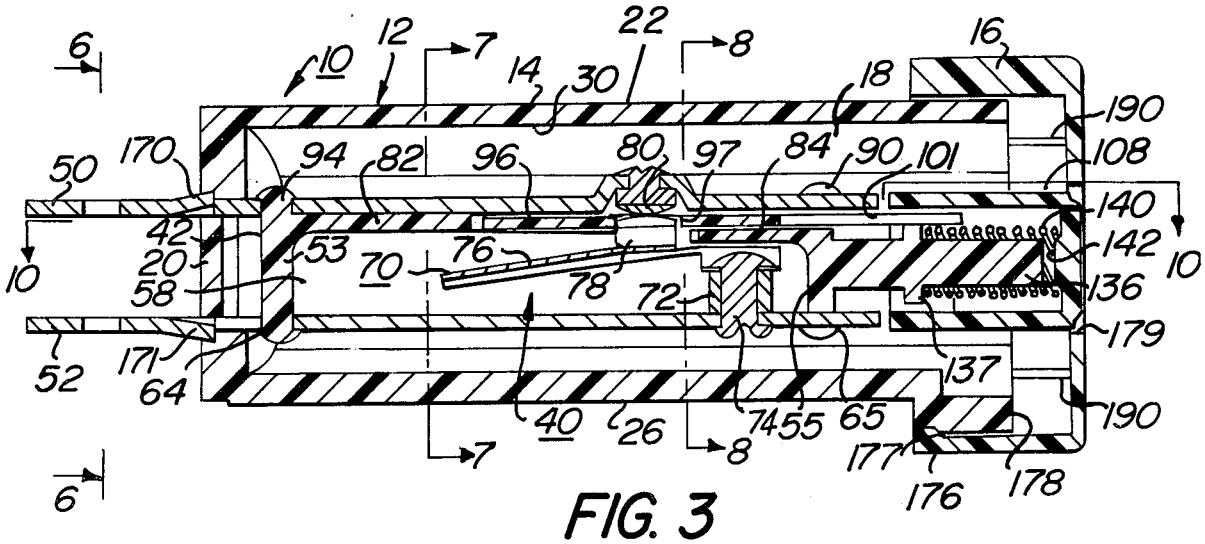
FIG. 3 is a longitudinal sectional view, taken along the line 3—3 in FIG. 1 and at approximately the scale of FIG. 2, showing the contacts closed position of the circuit breaker.

FIGS. 7 and 8 are cross-sectional views taken along the lines 7—7 and 8—8 in FIG. 3;

FIG. 9 is a cross-sectional view taken along the line 9—9 in FIG. 4;

FIGS. 10 and 11 are longitudinal views taken along the lines 10—10 (in FIG. 3) and 11—11 (in FIG. 4), respectively;

FIG. 12 is an exploded, top perspective view of the slide and button;

FIG. 13 is an end perspective view of the button which receives a part of the slide shown in FIG. 12;

FIG. 14 is a bottom perspective view of the frame;

FIG. 15 is a top perspective view of the load terminal and bimetallic blade sub-assembly;

FIG. 16 is a side elevation view of a modified load terminal and bimetallic sub-assembly which includes a heater;

FIG. 17 is a top view of the load terminal and bimetallic sub-assembly shown in FIG. 16;

FIG. 18 is a view taken along the line 18—18 in FIG. 16; and

FIG. 19 is a sectional view taken along the line 19—19 in FIG. 17.

DESCRIPTION OF THE PREFERRED EMBODIMENT

Referring to the drawings, the circuit breaker 10 comprises an insulator housing 12, preferably molded from an electrically insulating plastic material, consisting of a tubular case 14 and a cover 16 therefor. The case 14 defines an elongated cavity 18, FIGS. 3, 4 and 5, and an open right hand end, but is substantially closed at its left hand end by an end wall 20.

The case 14 and the cover 16 are formed with outer generally circular surfaces 22 and 24, respectively, to define a circuit breaker 10 whose appearance is that of a long cylinder. The outer surface 22, as shown in FIGS. 3 to 8 has a narrow, flat portion 26 which cooperates with a correspondingly shaped portion of the panel (not shown) within which the circuit breaker 10 is placed to restrain rotation of the case 14 relative to the panel.

Figure 2:
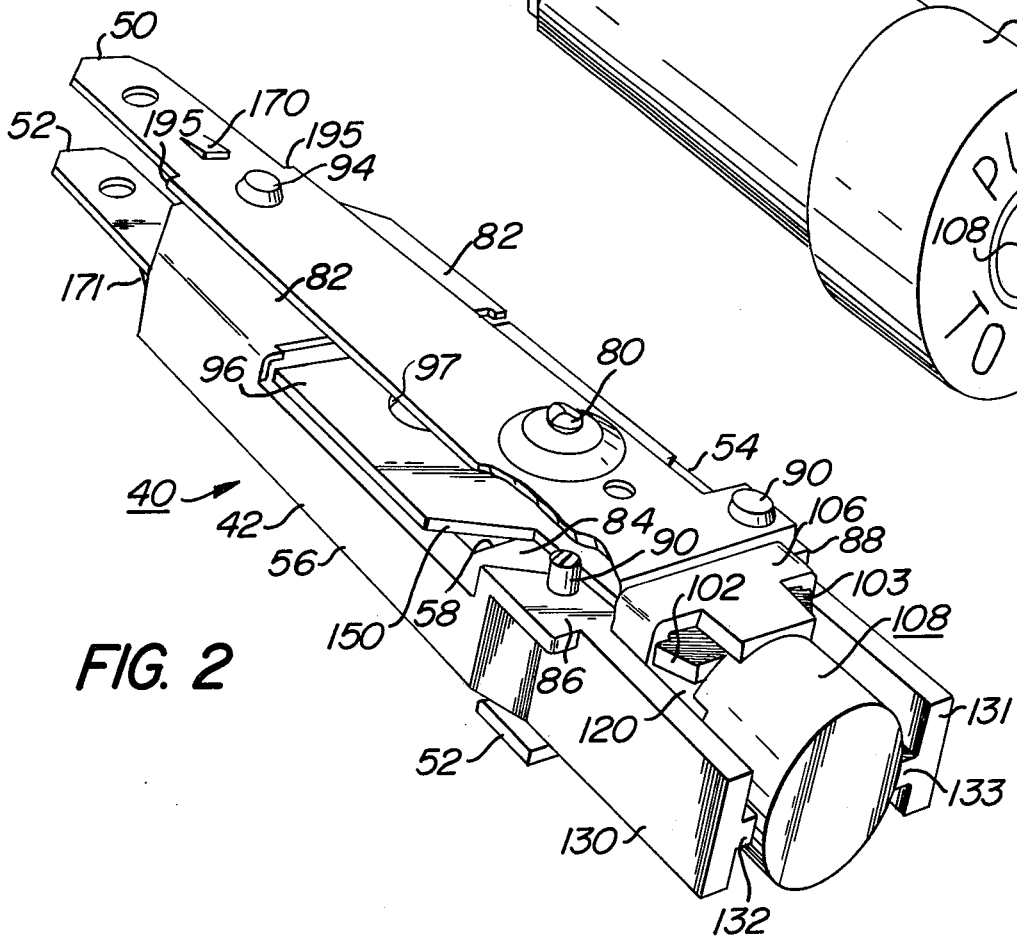
FIG. 2 is a front and top perspective view of the sub-assembly of this invention illustrated at an enlarged scale relative to FIG. 1.

The interior wall 30 of the case 14 defining the elongated cavity 18 is generally circular in cross-section, as shown in FIGS. 7 to 9, and receives a sub-assembly 40, illustrated in perspective in FIG. 2.

The sub-assembly 40 comprises a relatively long and narrow frame or block 42 of electrically insulating material, preferably molded from a suitable plastic. The frame 42 is generally rectangular in cross-section, as shown in FIGS. 7 to 9 and has two opposite side walls 54 and 56 (FIG. 7) which are slidably received in two suitable channels 43 and 44 formed in the interior wall 30.

The frame 42 carries two elongated, T-shaped terminals 50 and 52 on its opposite sides, a slide 96 between the two terminals 50 and 52, a button 108 hinged to the slide 96 and a spring 140 for biasing the slide 96 and the button 108 to the right, as viewed in FIGS. 3, 4 and 5, i.e., the contacts open position. The slide 96 and the button 108 are collectively referred to as an actuator 99.

The frame 42 comprises the side walls 54 and 56 and end walls 53 and 55 together peripherally bounding a cavity 58 on four sides. The walls 53 and 55 define two lower surfaces 60 and 61 at opposite ends of the frame 42 against which is placed the terminal 52. The walls 53 and 55 also include integral lugs 64 and 65 which extend through suitable holes in the terminal 52. The terminal 52 is secured to the frame 42 by ultrasonically deforming the ends of the lugs 64 and 65 which extend beyond the terminal so as to form bosses which are shown in FIGS. 3, 4 and 5.

Prior to assembly of the terminal 52 to the frame 42, however, a snap acting bimetallic blade 70 is secured to the terminal 52 on a post 72 by a rivet 74 which extends through the post 72 and suitable holes in the blade 70 and the terminal 52, the rivet 74 having its lower end peened over against the terminal 52, as shown in FIGS. 3, 4 and 5.

The blade 70 extends longitudinally in the same general direction of the terminals 50 and 52 and is only slightly greater than the width of the terminal 52 so that the blade 70 and the terminals 50 and 52 could be said to have approximately the same width. The width of the cavity 58 is made slightly larger than that of the blade 70 so as to permit it to freely flex and snap without interference with the side walls 54 and 56.

The blade 70 includes a tongue 76 which carries a movable contact 78 which in the contacts closed position of the circuit breaker abuts a stationary contact 80, as shown in FIG. 3. The stationary contact 80 is suitably secured to the line terminal 50, preferably by being riveted thereto, as shown.

The frame 42 includes a bridging wall 82, integral with the walls 53, 54 and 56, and another bridging wall 84, integral with the walls 54, 55 and 56. From the bridging wall 84 extend two platforms 86 and 88, FIG. 2, from which in turn, lugs 90 extend which extend through suitable holes in the terminal 50. Likewise, the bridging wall 82 has a lug 94 extending through a suitable hole in the terminal 50. The portions of the lugs 90 and 94 extending beyond the terminal 50 are ultrasonically heated to form bosses, as shown in FIGS. 2 and 3, to secure the terminal 50 against the bridging wall 82 and against the platforms 86 and 88.

The side walls 54 and 56, the bridging wall 84 and the platforms 86 and 88 together with the terminal 50 define a recess which slidably receives the slide 96. The slide 96 includes a generally flat and wide body 95 having an elongated opening 97 which has a narrow dimension slightly larger than the diameter of the movable contact 78 and a longer dimension substantially greater than the diameter of the movable contact 78. The movable contact extends through the opening 97 into abuttment with the stationary contact 80 in which position movement of the slide 96-button 108 to the right under the bias of the spring 140 is restrained by engagement of the movable contact 78 with a part of the slide 96 defining the opening 97, as shown in FIG. 3.

The slide 96 also includes integral spaced legs 100 and 101 extending to the right, as seen in FIG. 12, with outwardly projecting feet 102 and 103, respectively. The slide is made of electrical insulating material of sufficient flexibility for the legs 100 and 101 to be sufficiently squeezed toward each other so that the feet 102 and 103 may be inserted into mating openings 104 and 105 in the peripheral end wall 106 of the button 108, FIGS. 12 and 13. When the squeezing force is removed the legs 100 and 101 spring outwardly to their initial position at which time the feet 102 and 103 project sufficiently behind the wall 106 through openings 120 on opposite sides of the rib 112. (To facilitate assembly of the slide 96 to the button 108, the button 108 is made symmetrical, as shown.)

Referring to FIG. 13, longitudinal ribs 112 and 113 and channels 114 and 115 connect the peripheral end wall 106 with the thimble-like hollow head 118 of the button 108. Thus, the side openings 120 (FIG. 12) are formed between the upper rib 112 and the side channels 114 and 115, the feet 102 and 103 having hook portions which are engageable with the end wall 106 on one side and with the thimble-like button head 118 on the other side to limit movement of the slide 96 and button 108 relative to each other.

Extending to the right, as viewed in FIGS. 2 and 14, from the peripheral wall 55 of the frame 42 are side rails 130 and 131 together defining a space 135. The rails 130 and 131 include extending tongues 132 and 133, see also FIG. 9, which are slidably received in corresponding grooves formed in the end wall 106 and the channels 114 and 115 of the button 108.

From the peripheral wall 55 of the frame 42, a post 136 extends (as shown in FIGS. 3 to 5, 9, 11 and 14), the post 136 including an annular boss 137 against which seats a spring 140. The spring 140 is carried around the post 136 and is in compression, the spring 140 being seated at its left against the boss 137 and at its right it bears against the inside vertical surface of the button head 118, as shown in FIGS. 3 to 5, so as to bias the actuator 99, i.e., the button 108-slide 96 sub-assembly, to the right both in the contacts closed (FIG. 3) and contacts open (FIG. 5) positions.

From the foregoing it is seen that the slide 96 and the button 108 are pre-assembled as a two piece actuator 99 with the feet 102 and 103 inserted into the button 108, FIG. 12. The sub-assembly actuator 99 (the slide 96-button 108) is then added to the frame 42 by sliding the tongues 132 and 133 into the grooves formed in the channels 114 and 115. The slide 96 at such time is cocked upwards slightly to clear the lugs 90, the feet 102 and 103 pivoting in the openings 104 and 105 at this time. The actuator 99 consisting of the slide 96-button 108 is then moved toward the frame 42 until the enlarged portion of the slide 96 clears the lugs 90 and the platforms 84 and 86 at which time the slide 96 drops down against the bridging surface 84 and the side walls 54 and 56. The slide 96 and the button 108 thus become trapped to only the frame 42.

Movement up and down of the button 108, as viewed in FIG. 9, is restrained by the tongues 132 and 133 in the corresponding grooves of the channels 114 and 115. Movement of the slide 96 up and down is limited by the terminal 50 on the top and the walls 54, 56 and 84 on the bottom which sandwich the slide 96 between them. Movement of the slide 96-button 108 sub-assembly to the left is limited by the abutment of the post 136 and vertical wall 142 (FIG. 3) of the button head 118 and movement to the right is limited by abutment of the tapered surfaces 150 and 151 (FIG. 12) with corresponding surfaces 152 and 153 on the platforms 86 and 88 (FIGS. 2, 10 and 11).

The bimetallic blade 70 is of the Taylor type, bimetallic blades of this type being generally disclosed in the U.S. Pat. No. 3,569,888 and British Pat. No. 657,434, although other types of bimetallic blades could also be used.

The blade 70 has a U-shaped cut out portion to define the tongue 76 which carries the movable contact 78. One end of the blade 70 is deformed into a U-shape in cross section, as viewed in FIG. 8, and the base of the U-shape thus formed is secured to the post 72 by the rivet 74.

With the slide 96-button 108 in the position shown in FIG. 3, the contact 78 is biased by the tongue 76 against the stationary contact 80, the movable contact 78 extending through the hole 97 in the slide 96, as shown. Upon sufficient heating of the blade 70, the tongue 76 snaps from the closed contacts position of FIG. 3 to the tripped open position of FIG. 4 opening the contacts 78 and 80, and the slide 96-button 108 sub-assembly moves to the right under pressure of the spring 140.

When the bimetallic blade 70 snaps, it moves to the momentary tripped position shown in FIG. 4. At such time, as illustrated in FIG. 4, the left hand end of the blade 70 and the right hand end of the tongue 76 are spaced from the bridging wall 82 and the terminal 52. Depending on various factors, such as the amount of the overload, the blade 70 may move to a momentary trip position other than that illustrated in FIG. 4. For example, the left hand end of the blade 70 may engage the bridging wall 82 and/or the right hand end of the tongue 76 may engage the terminal 52.

During flexure of the blade 70 the right hand portion thereof (the part secured to the post 72) flexes also but the bridging wall 84 is spaced sufficiently therefrom as to permit the flexing to freely take place.

Upon sufficient cooling of the blade 70 the tongue 76 snaps upwardly toward the position of FIG. 3, but is prevented from assuming the position of FIG. 3 by the slide 96, because the hole 97 in slide 96 has moved to the right and the contact 78 now engages the underside of the slide 96, preventing it from making contact with the stationary contact 80, as shown in the contacts open position of FIG. 5.

The terminals 50 and 52 are provided with tangs 170 and 171 centrally pressed out from the terminals 50 and 52, FIGS. 3 to 6. The terminals 50 and 52 extend through the end wall 20 which is provided with holes 174 and 175, FIGS. 3 to 6, to receive the terminals 50 and 52. The holes 174 and 175 have enlarged portions, as shown, to receive the tangs 170 and 171. When the terminals 50 and 52 are placed into the holes 174 and 175, the tangs 170 and 171 flex back toward the terminals as the terminals are pushed through the end wall and after the tangs 170 and 171 pass through the end wall 20 they snap back to the positions shown in FIGS. 3 to 5 restraining movement of the terminals 50 and 52 to the right.

Movement of the terminals 50 and 52 to the left is restricted and, hence, movement of the entire sub-assembly 40 is restricted, by the abutment of shoulders 195 (FIGS. 2, 10, 11 and 15) formed on the terminals 50 and 52 with the end wall 20. Since the left hand end of the case 14 is provided with tapered walls 200 and 201 (FIGS. 1, 6, 10 and 11), the left hand end of the frame 42 is correspondingly tapered and spaced from the wall 20, 200 and 201 so that the limiting stop function is provided by the shoulders 195 on the terminals 50 and 52. Rotation of the sub-assembly 40 relative to the case 14 is also limited by the reception of the walls 54 and 56 in the channels 43 and 44.

The case 14 is closed at its right hand end, as viewed in FIGS. 3 to 5, by the cover 16 which has a radially inwardly extending lip 176 which snaps over a mating shoulder 177 formed on a collar 178 at the right hand end of the case 14. If desired the cover 16 may be suitably secured to the case 14 by adhesive or by ultrasonic welding.

Figure 1:
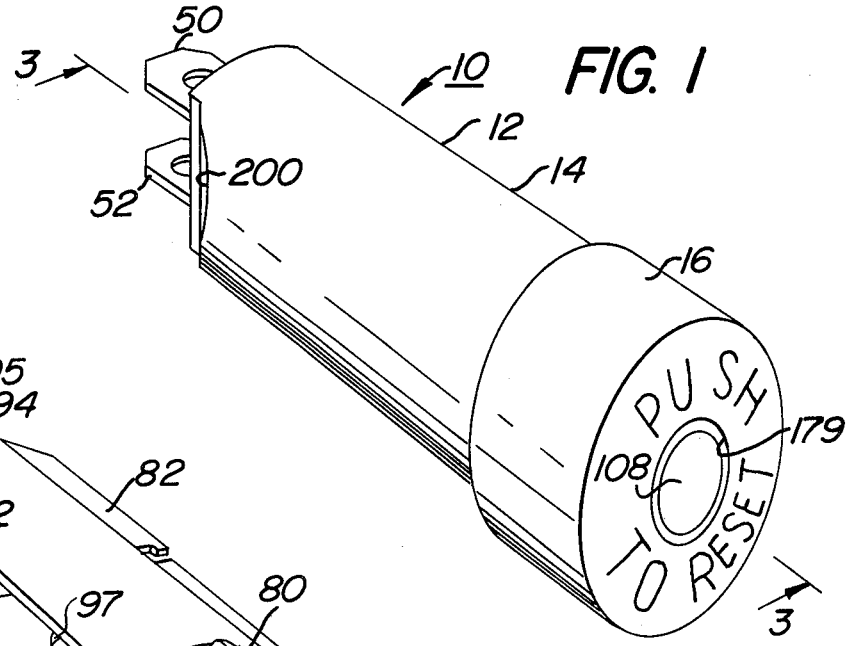
FIG. 1 is a front and top perspective view of the bimetallic circuit breaker incorporating the present invention.

The cover 16, however, is provided with a central hole 179 through which the button 108 may extend in the electrically tripped position (FIG. 4) and the contacts open position (FIG. 5). Also, the front face of the cover may carry suitable instructions, as shown in FIG. 1, and to properly orient the cover relative to the case 14 a notch 180 (FIGS. 7 and 9) may be placed in the case 14 to receive a projection 181 carried by the cover 16. To limit movement of the cover 16 to the left, the inside peripheral surface of the cover 16 is provided with projecting columns 190 (FIGS. 3 to 5) which abut the right hand end surface of the case 14, as shown. From a mechanical and electrical point of view, it should be noted that the cover 16 is not needed, the unit being secured to the case 14. The cover 16 is, of course, required for safety and appearance.

FIG. 3 it is thus seen illustrates the circuit breaker in the contacts closed position after the force upon the button 108 tending to reset the button 108 to the contacts closed position has been removed therefrom. The reset force on the button pushes the vertical wall 142 against the post 136 (limiting its travel) and moving the opening 97 over the movable contact 78 at which time the latter enters the opening 97 and engages the stationary contact 80. Upon removal of the reset force the slide 96-button 108 sub-assembly moves to the right until a part of the peripheral wall defining the opening 97 hooks onto the contact 78 at which time movement of the slide 96-button 108 is arrested in the position illustrated in FIG. 3.

The circuit breaker 10 of this invention may be manually reset from the contacts open position of FIG. 5 to the contacts closed position of FIG. 3, as described, but will move from the contacts closed position of FIG. 3 to the contacts open position of FIG. 5 only on sufficient electrical overload, i.e., on flexing of the bimetal blade 70 sufficiently to move the contact 78 down out of restraining engagement with the slide 96. That is, the circuit breaker 10 may not be manually moved from the contacts closed to the contacts open position.

While a specific construction has been described, it will be observed that certain modifications could be made. For example, the slide 96 and the button 108 could be made integral.

Also, while the cavity or space 58 has been described as bounded by the walls 53, 54, 55 and 56, it is seen that one or the other of walls 54 or 56 could be eliminated. Also, by securing the terminals 50 and 52 to one of the other walls, the wall 53 could also be eliminated.

Likewise, the actuator 99 need not be keyed to rails 130 and 131 since if appropriate keying to one or the other of the rails is made, the other rail may be omitted. Further, if the actuator 99 is keyed to the wall 55 or to one of the side walls 54 or 56, neither of the rails 130 and 131 would be required.

Similarly, the spring 140 could be positioned between the wall 55 and the actuator 99 or one of the walls 54 or 56 and the actuator 99.

From the foregoing it is seen that the frame 42 has the following functions: the terminals 50 and 52 are secured to the frame 42; the terminals 50 and 52 are maintained spaced apart from each other by the correct distance by the frame 42; the cavity 58 is formed by the frame 42; the button 108 is guided by the frame 42; the space 135 is defined by the frame 42; the spring 140 is carried by the frame 42; the slide 96 is guided by the frame 42; and the sub-assembly 40 is seated relative to the tubular case 14 by the marginal portions of the frame 42 which are received in the channels 43 and 44.

Referring to FIGS. 16 to 19, a modified load terminal 300 is shown carrying a serpentine-shaped flat resistance heater 302.

The heater 302 is carried by an electrical insulating layer 301 which is placed against one side of the terminal 300, as shown, between the terminal and the snap acting bimetallic blade 304. The left hand end of the heater 302 is secured by a conducting tubular rivet 303 to the terminal 300, the rivet 303 extending through the terminal 300 and being flared over at opposite ends is shown, to mechanically and electrically connect the terminal 300 and heater to each other. The right hand end of the heater 302 is secured to the terminal 300 by another rivet 305 which extends through the blade 304 and the terminal 300, as shown, and is peened over.

The rivet 305 extends through a bushing 310 of electrical insulating material, the bushing 310 being flared over at opposite ends, as shown, to support the head of the rivet 305 at the top and against which is peened-over the lower portion of the rivet 305. Seated upon the right hand end of the heater 302 and in contact therewith is a post 312 of electrically conductive material which extends from the heater 302 to the blade 304 and upon which the right hand end portion of the blade 304 is seated.

Thus, the electrical path is from the left hand side of the terminal 300, through the rivet 303, through the heater 302, and through the bushing 310 to the blade 304.

Thus, the heater 302 is also disposed with the blade 304 in the space formed by a frame and space, corresponding to the frame 42 space 58 in FIG. 14.

Having described the invention, it is claimed:

1. A bimetallic circuit breaker comprising
a housing,
a sub-assembly received by said housing and comprising
a frame defining a space,
first and second terminals secured to said frame,
said first terminal including a stationary contact,
said second terminal including a snap acting bimetallic blade having a movable contact,
said bimetallic blade being disposed in said space and movable on predetermined conditions from a contacts closed position to a contacts tripped position and thereafter to a contacts open position,
an actuator slidably trapped to said frame and interposed between said first terminal and said frame,
said actuator having an opening through which said movable contact extends to abut said stationary contact to restrain movement of said actuator by engagement of said movable contact with said actuator, and
a spring trapped between portions of said frame and said actuator and biasing said actuator to the contacts open position.

2. The structure recited in claim 1 wherein
said actuator extends out of said housing upon electrical tripping opening of said contacts.

3. The structure recited in claim 2 wherein
said frame includes a wall bounding said space on one side and a post extending from said wall on the side opposite said space, and
said spring being mounted on said post.

4. The structure recited in claim 3 wherein
said frame includes a rail extending from said wall on the same side of said wall as said post, and
said actuator having a portion keyed to said rail for slidable movement of said actuator relative to said rail.

5. The structure recited in claim 4 wherein
said terminals, bimetallic blade, and frame extend along the same longitudinal axis.

6. The structure recited in claim 5 wherein
said terminals extend beyond said frame at the same end of said frame,
said housing includes an open ended tubular case closed at one end by an end wall and open at the other end,
said end wall having openings through which said terminals extend and to which said sub-assembly is secured, and
a cover closing the open end of said case.

7. The structure recited in claim 6 wherein
said terminals include pressed out tangs engaging said end wall to limit movement of said sub-assembly in one longitudinal direction, and
said frame abuts said end wall to limit movement of said sub-assembly in the opposite longitudinal direction.

8. The structure recited in claim 7 wherein
said tubular case includes a longitudinal groove slidably receiving a marginal portion of said frame.

9. The structure recited in claim 1 wherein
said actuator comprises
a slide, and
a button hinged to said slide by end portions of said slide which extend loosely into openings in said button.

10. The structure recited in claim 1 wherein
said bimetallic blade is mounted on a post extending into said space.

11. The structure recited in claim 1 wherein
said actuator extends out of said housing upon electrical tripping opening of said contacts,
said frame includes a wall bounding said space on one side and a post extending from said wall on the side opposite said space,
said spring being mounted on said post,
said frame includes a rail extending from said wall on the same side of said wall as said post,
said actuator having a portion keyed to said rail for slidable movement of said actuator relative to said rail,
said terminals, bimetallic blade, and frame extend along the same longitudinal axis,
said terminals extend beyond said frame at the same end of said frame,
said housing includes an open ended tubular case closed at one end by an end wall and open at the other end,
said end wall having openings through which said terminals extend and to which said sub-assembly is secured,
a cover closing the open end of said case, said terminals include pressed out tangs engaging said end wall to limit movement of said sub-assembly in one longitudinal direction, said tubular case includes a longitudinal groove slidably receiving a marginal portion of said frame, said actuator comprises a slide and a button hinged to said slide by end portions of said slide which extend loosely in openings in said button, said bimetallic blade is mounted on a post extending into said space.

12. The combination recited in claim 1 and further including a heater secured to said second terminal in electrical series with said movable contact and disposed within said space.

13. A bimetallic circuit breaker comprising a housing, and a sub-assembly comprising a frame of electrical insulating material including first and second walls, said first and second walls defining a first space therebetween, said second wall bounding a second space, first and second terminals secured to said frame, said first terminal carrying a stationary contact positioned above said first space, said second terminal carrying a bimetallic snap acting blade positioned within said first space, an actuator of electrically insulating material slidably trapped between said stationary contact and said first space and movable back and forth between a contacts closed position and a contacts open position, said actuator including a body disposed above said first space at all times, said actuator including a button disposed in said second space, and a spring disposed in said second space and trapped between said frame and said button to bias said actuator to the contacts open position at all times, said body including a peripheral wall defining an opening through which said movable contact extends to abut said stationary contact in the contacts closed position, said peripheral wall engaging said movable contact in the contacts closed position of said movable contact to restrain movement of said actuator, whereupon when the movable contact snaps to the electrically tripped open position, the actuator moves to the contacts open position under pressure of said spring.

14. The combination of claim 13 wherein said first and second walls of said frame have an L-shaped arrangement.

15. The combination of claim 13 and further including a third wall extending from said second wall, said first, second and third walls being arranged in a T-shape.

16. The combination of claim 13 and further including a third wall extending from said second wall, said first and third wall being generally parallel to each other, but extending in opposite directions from opposite ends of said second wall which is between said first and third walls.

17. The combination recited in claim 11 and further including a heater secured to said second terminal in electrical series with said movable contact and disposed within said space.

18. The combination recited in claim 13 and further including a heater secured to said second terminal in electrical series with said movable contact and disposed within said space.

19. The combination recited in claim 16 and further including a heater secured to said second terminal in electrical series with said movable contact and disposed within said space.

* * * * *